US011732425B2

(12) United States Patent
Hays

(10) Patent No.: US 11,732,425 B2
(45) Date of Patent: Aug. 22, 2023

(54) APPARATUS FOR DISTRIBUTING CEMENT

(71) Applicant: Michael Hays, Ruston, LA (US)

(72) Inventor: Michael Hays, Ruston, LA (US)

( * ) Notice: Subject to any disclaimer, the term of this patent is extended or adjusted under 35 U.S.C. 154(b) by 738 days.

(21) Appl. No.: 16/743,711

(22) Filed: Jan. 15, 2020

(65) Prior Publication Data

US 2020/0224375 A1 Jul. 16, 2020

Related U.S. Application Data

(60) Provisional application No. 62/792,970, filed on Jan. 16, 2019.

(51) Int. Cl.
*E01C 19/20* (2006.01)
*E01C 19/47* (2006.01)

(52) U.S. Cl.
CPC ..... *E01C 19/205* (2013.01); *E01C 19/475* (2013.01); *E01C 2019/207* (2013.01); *E01C 2301/02* (2013.01)

(58) Field of Classification Search
CPC ..... E01C 19/205; E01C 19/475; E01C 2019/207; E01C 2301/02
See application file for complete search history.

(56) References Cited

U.S. PATENT DOCUMENTS

| | | | | |
|---|---|---|---|---|
| 2,099,369 | A | 11/1937 | Lutz | |
| 2,200,165 | A | 5/1940 | Fulerson et al. | |
| 3,189,355 | A | 6/1965 | Swenson et al. | |
| 6,345,931 | B1 | 2/2002 | Capece | |
| 6,419,418 | B1 | 7/2002 | Smith | |
| 6,786,435 | B2 | 9/2004 | Mishra | |
| 7,462,279 | B2 | 12/2008 | Dixon et al. | |
| 7,540,687 | B2 * | 6/2009 | Neumann | E01C 19/182 404/104 |
| 7,980,484 | B1 | 7/2011 | Podoll et al. | |
| 7,993,451 | B2 | 8/2011 | Brouillette et al. | |
| 8,430,956 | B2 | 4/2013 | Brouillette et al. | |
| 8,714,809 | B2 | 5/2014 | Brouillette et al. | |
| 8,813,864 | B2 | 8/2014 | Layton | |
| 2016/0311612 | A1 * | 10/2016 | Ozinga | B28C 7/049 |
| 2019/0063008 | A1 * | 2/2019 | Benesch | E01C 19/203 |

FOREIGN PATENT DOCUMENTS

| | | | | |
|---|---|---|---|---|
| AU | 2015255282 | A1 * | 10/2016 | |
| AU | 2018274990 | A1 * | 1/2019 | |
| BR | 202020005752 | U2 * | 5/2020 | B65D 83/06 |

* cited by examiner

*Primary Examiner* — Abigail A Risic
(74) *Attorney, Agent, or Firm* — John J. Patti; Patti Pershem, PLLC

(57) ABSTRACT

There is a hopper having a substantially closed interior space that is configured to receive a binder, a fill assembly that is configured to be in fluid communication with the interior space of the hopper, and an exit port. Secured to the hopper is a base with at least one carrier. A pneumatic pump is secured to the hopper. An ingress pipe is secured to be in fluid communication with the pneumatic pump. A valve housing is secured to the ingress pipe and the exit port of the hopper. A valve is secured within the valve housing. An egress pipe is secured to the valve housing, and a spreader bar is secured to the egress pipe.

14 Claims, 5 Drawing Sheets

APPARATUS FOR DISTRIBUTING CEMENT

CROSS-REFERENCE

This application claims priority to U.S. Patent Application Ser. No. 62/792,970 by Mike Hays, which was entitled "METHOD AND APPARATUS FOR DISTRIBUTING CEMENT," and was filed on Jan. 16, 2019. This application is incorporated by reference for all purposes.

TECHNICAL FIELD

The invention relates generally to a distributor and, more particularly, to a distributor for a dry, abrasive, powdery mixture.

BACKGROUND

In certain applications (such as oil field and military applications), it is oftentimes necessary to be able to quickly and inexpensively perform construction in rural and undeveloped areas, which requires roads. Previously, rapid road construction was accomplished by way of a spreading truck. The spreading truck is typically a road-mobile conventional cab and trailer, where concrete is distributed from the back of the trailer through a conveyor or through a pneumatic mechanism. Examples of commercially available spreader trucks are available through Stoltz Manufacturing, LLC of Morgantown, Pa. Some other conventional examples are: U.S. Pat. Nos. 2,099,369; 2,200,165; 3,189,355; 6,345,931; 6,419,418; 6,786,435; 7,462,279; 7,980,484; 7,993,451; 8,430,956; 8,714,809; and 8,813,864.

However, these conventional solutions are plagued with problems. Typically, the trailers of the spreader trucks are open, which exposes the dry mixture to rain and moisture, and which limits the times when the trucks can be loaded (i.e., with ideal weather conditions). Moreover, even for those trucks which are closed, there are other problems. First, it is usually very difficult—if not impossible—for a truck driver to evenly spread the mixture because it is occurring dozens of feet behind the driver and is obscured by the trailer. Second, the spreading trucks are typically road mobile and travel from load site to job site by way of conventional roads. Jobs sites are, by definition, rough (meaning that the site may be muddy). As a result, the spreader trucks, upon reentering a roadway, may have muddy tires, which can be hazardous for other drivers on the road and which may create liability issues. Third, because the mixture is being distributed from the back of the truck, other workers are required to follow the spreader trucks on foot (which can be hazardous for the workers following on foot).

Therefore, there is a need for an improved method and apparatus for distributing a dry, abrasive mixture.

SUMMARY

An embodiment of the present disclosure, accordingly, provides an apparatus. The apparatus comprises: a hopper having: a substantially closed interior space that is configured to receive a binder; a fill assembly that is configured to be in fluid communication with the interior space of the hopper; and an exit port; a base that is secured to the hopper, wherein the base includes at least one carrier; a pneumatic pump that is secured to the hopper; an ingress pipe that is secured so as to be in fluid communication with the pneumatic pump and that is secured to the base; a valve housing that is secured to the ingress pipe and the exit port of the hopper, wherein the valve assembly is configured to be in fluid communication with the pneumatic pump; a valve that is secured within the valve housing, wherein the valve is configured to be pneumatically controlled; an egress pipe that is secured to the valve housing and that is secured to the base; and a spreader bar that is secured to the egress pipe.

In accordance with an embodiment of the present disclosure, the hopper further comprises: an upper segment that is secured to the fill assembly; and a lower segment having the exit port, wherein the lower segment narrows between upper segment and the exit port.

In accordance with an embodiment of the present disclosure, the upper segment is substantially circular and wherein the lower assembly is substantially frustoconical in shape.

In accordance with an embodiment of the present disclosure, the apparatus further comprises a frame secured between the hopper and the base.

In accordance with an embodiment of the present disclosure, the carrier of the base further comprises first and second carriers, wherein each of the first and second carriers is substantially rectangular in shape and is dimensioned to receive a fork tine, and wherein the first and second carriers are substantially parallel to and separated from one another.

In accordance with an embodiment of the present disclosure, the base is substantially rectangular, and wherein the upper assembly is substantially rectangular with substantially the same area as that of the base.

In accordance with an embodiment of the present disclosure, the frame further comprises: a first outer wall that is secured along a first edge of the base and a first edge of the upper segment; a second outer wall that is secured along a second edge of the base and a second edge of the upper segment, wherein the first and second outer walls are substantially parallel to one another; and an inner support that is secured to the first and second carriers and the lower segment.

In accordance with an embodiment of the present disclosure, a method is provided. The method comprises: engaging first and second carriers of a base of a distribution box with first and second tines of a fork of a loader; lifting the distribution box with the first and second tines of a fork; activating pneumatic pump with a hydraulic motor of the loader to generate pneumatic pressure; providing moving air from the pneumatic pump through an ingress pipe to a valve housing and from the valve to a spreader bar through an egress pipe; creating pressure on a binder at an exit port of a hopper by creating a gradient with a narrowing segment of the hopper; activating a valve secured to the valve housing at the exit port of the hopper so as to mix the binder exiting the hopper; moving the loader along an unfinished surface; and distributing the mixture of air and binder through the spreader bar onto an unfinished surface while moving.

In accordance with an embodiment of the present disclosure, the method further comprises: measuring the weight of the distribution box and binder with the loader; and adjusting the speed at which the loader is moving along the unfinished surface.

In accordance with an embodiment of the present disclosure, the binder further comprises cement.

In accordance with an embodiment of the present disclosure, the binder further comprises sand.

In accordance with an embodiment of the present disclosure, the binder further comprises aggregate.

In accordance with an embodiment of the present disclosure, an apparatus is provided. The apparatus comprises: a base having a first area, wherein the base includes first and second carriers that each have a substantially rectangular cross-section and a length such that the first and second carriers are dimensioned to receive a tine of a fork, and wherein the first and second carriers are spaced apart from one another and are generally parallel to one another; a first outer wall that is secured along at least a first portion of the periphery of base; a second wall that is secured along at least a second portion of the periphery of the base; an inner support that is secured to the first and second carriers; a hopper having: an upper segment having a second area; and a lower segment having an upper end and a lower end, wherein the upper end of the lower segment is secured to the upper segment at a transition, and wherein the first outer wall is secured along a first portion of the transition, and wherein the second outer wall is secured along a second portion of the transition, and wherein the lower segment includes an exit port with a third area at the lower end of the lower segment, and wherein the third area is less than the second area, and wherein the inner support is secured to the lower segment; a valve housing that is secured to the exit port; a pneumatic pump; an ingress pipe that is secured between the pneumatic pump and the valve housing, wherein the ingress pipe is secured to the base; an egress pipe that is secured to the valve housing and the base; a valve that is secured with the valve housing, wherein the valve is configured to be pneumatically actuated; and a spreader bar that is secured to the egress pipe.

In accordance with an embodiment of the present disclosure, the hopper has an interior space, and wherein the apparatus further comprises a fill assembly that is secured to the hopper and is in fluid communication with the interior space of the hopper.

In accordance with an embodiment of the present disclosure, the first and second areas are substantially circular.

In accordance with an embodiment of the present disclosure, the lower segment has a substantially frustoconical shape.

In accordance with an embodiment of the present disclosure, the first and second areas are substantially rectangular.

In accordance with an embodiment of the present disclosure, the first and second areas substantially the same.

In accordance with an embodiment of the present disclosure, the first and second outer walls are substantially parallel to one another.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

Figure 1:
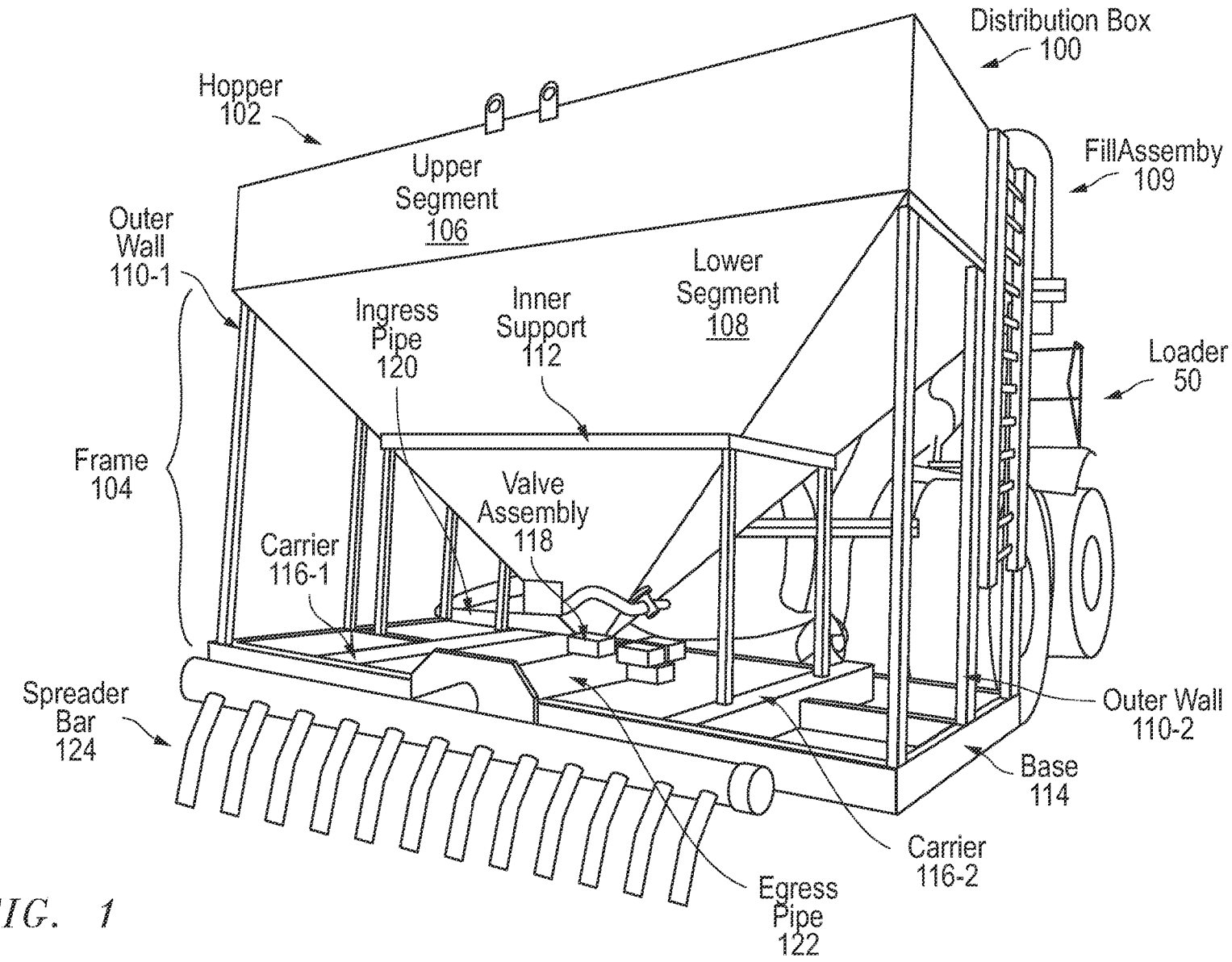
FIG. 1 is a right front isometric view of a distribution box mounted on a loader in accordance with an embodiment of the present disclosure.

Refer now to the drawings wherein depicted elements are, for the sake of clarity, not necessarily shown to scale and wherein like or similar elements are designated by the same reference numeral through the several views.

Figure 2:
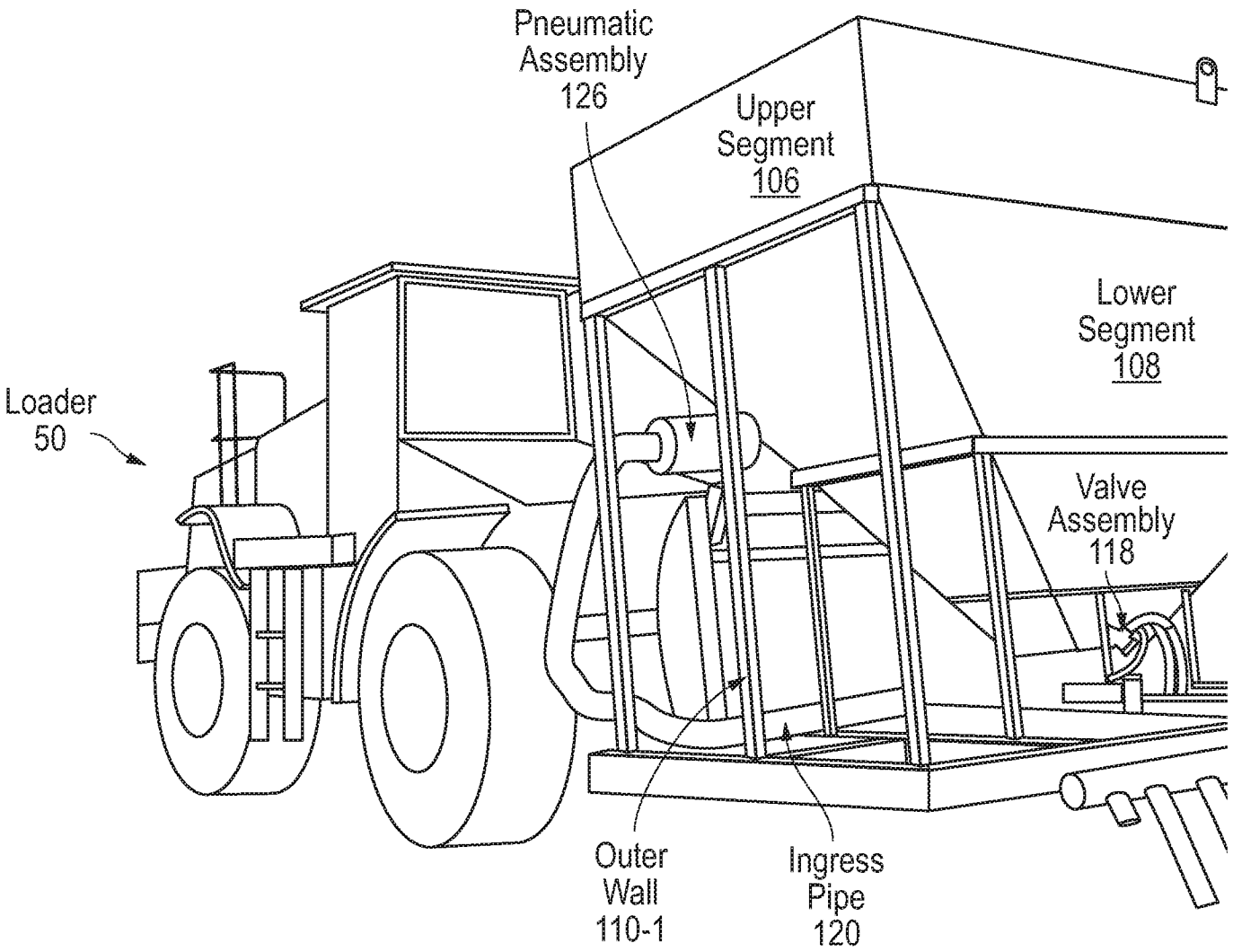
FIG. 2 is a left front isometric view of the distribution box mounted on the loader of FIG. 1.
Figure 3:
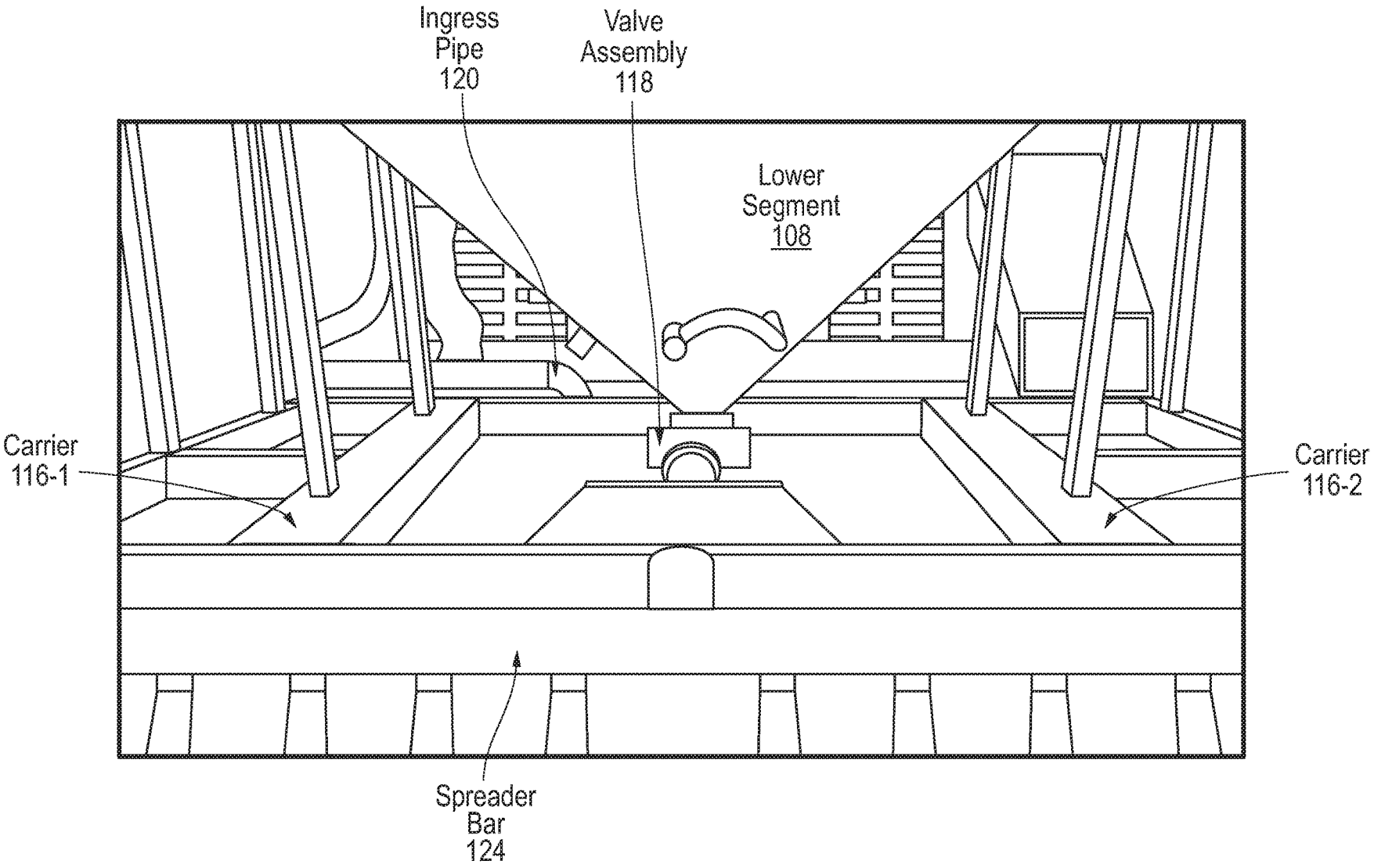
FIGS. 3 and 4 are close-up front views of the distribution box mounted on the loader of FIG. 1.
Figure 4:
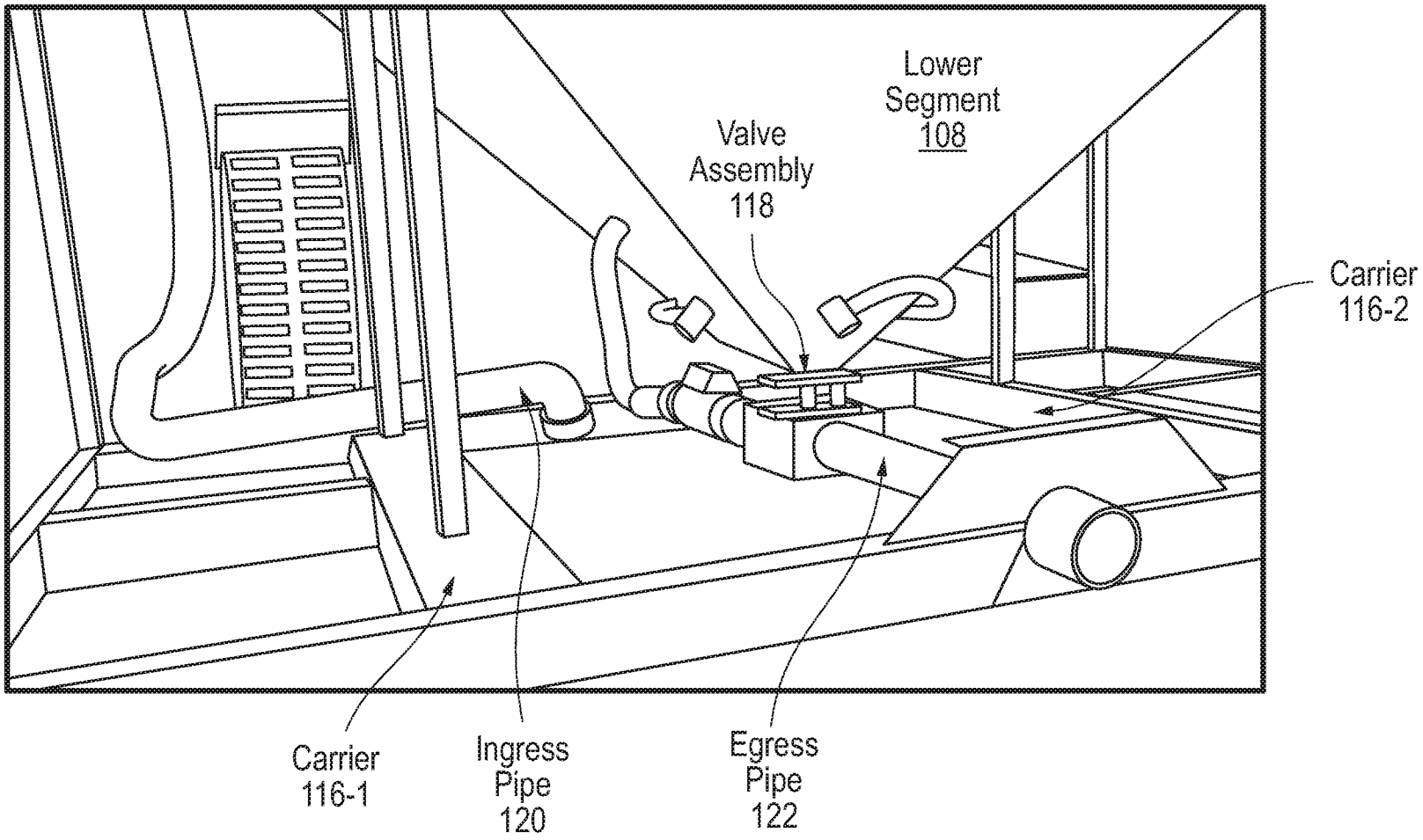
Figure 5:
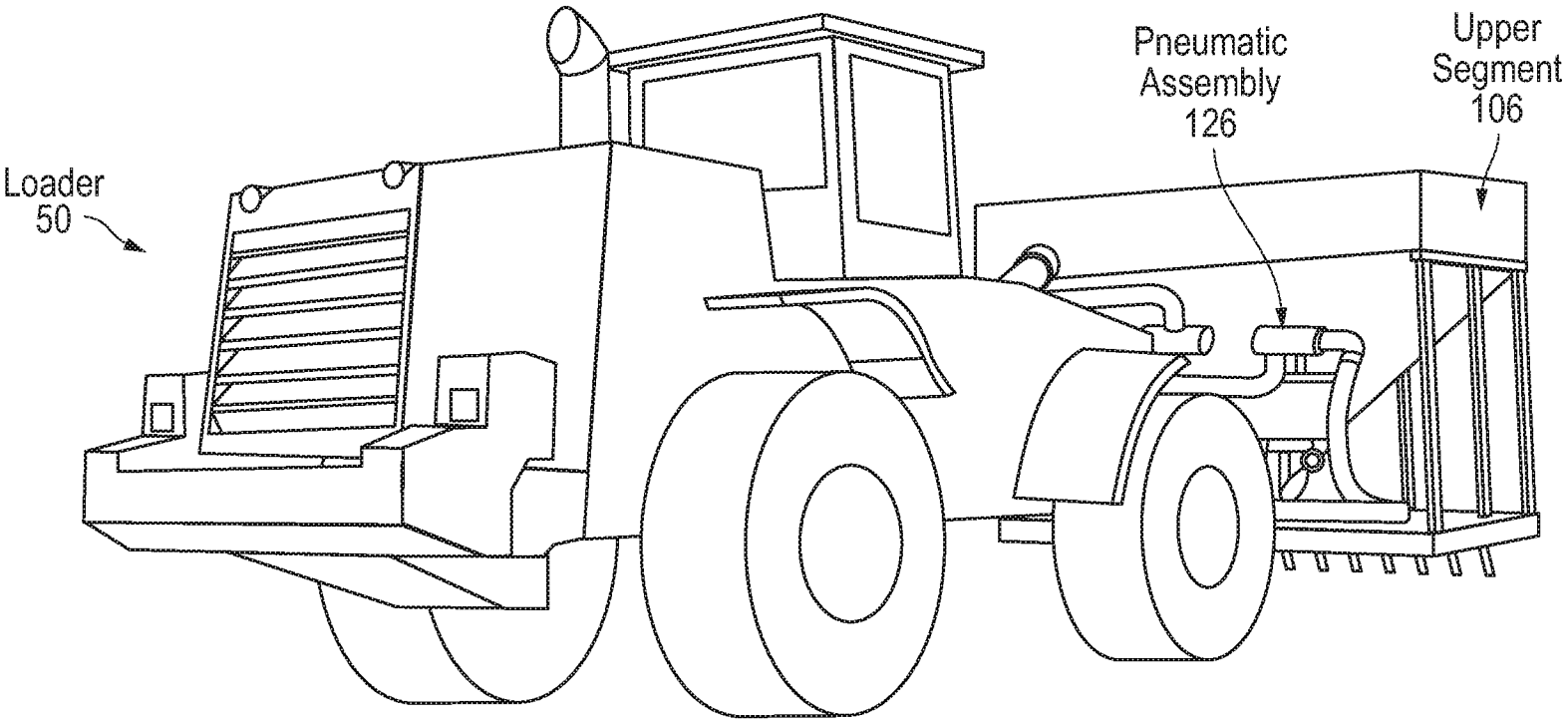
FIG. 5 is a rear isometric view of the distribution box mounted on the loader of FIG. 1.

Referring to FIGS. 1 to 5, an example of a distribution box 100 mounted on a loader 50 can be seen. The distribution box 100 is designed to distribute a dry, powdery mix (e.g., cement, cement and aggregate, cement and sand, concrete mix, or another binder) onto an unfinished road or path ahead of the driver, eliminating the need for any flagmen or foot-mobile monitors. As shown in this example, the loader 50 is an off-road vehicle that is not designed to travel on finished roadways—eliminating chances of depositing mud onto a road. Instead, the distribution boxes 100 can be loaded at a load site and trucked (e.g., on a flatbed truck) to the job site. Additionally, because the distribution boxes 100 are sealed, they can be trucked to a job site under any weather condition, stored at the job site, and applied to the unfinished road once weather conditions improve. It is also possible to use a loader 50 that is road-mobile. It is also desirable to have a loader with conventional forks (like a forklift) and a measurement mechanism that is capable of measuring the carrying weight. In the example of FIGS. 1-5, the loader 50 used is a CAT 972M Front-End Loader (available from Caterpillar, Inc.) with the bucket removed. For the example Front-End Loader, a fork tool equipped in the bucket's place so that it can operate in a similar manner to a forklift.

Now, turning to the distribution box 100, the largest portion is typically the hopper 102. The hopper 102 can be sealed with an interior space that can carry a dry, abrasive mixture (e.g., a binder like cement) so as to isolate the mixture from poor weather (e.g., rain). Loading of the hopper 102 can be accomplished through the fill assembly 109 (which is typically a valve, pipe, and adapter) that allows the mixture to be loaded through the lid (not shown). The hopper 102 can typically be divided into two segments: an upper segment 106 and a lower segment 108. As shown in this example, the upper segment 106 is generally shaped as a rectangular prism (although other shapes like generally oval, generally circular/spherical, or other rounded shapes are possible) and includes a lid (not shown). Typically, the upper segment 106 can be formed of welded sheet steel (e.g., 4 side plates and a lid plate), but other materials may be used. Along a transition, the upper segment 106 can be secured to the lower segment 108 (e.g., welded, brazed, or glued). As shown in the example of FIGS. 1-5, the lower segment 108 has a generally pyramidal shape that narrows toward its lower end; other shapes that narrow toward its lower end (like a narrowing frustoconical shape) may also be possible. Because of the shape of the lower segment 108, the hopper 102 can be largely cleared of material during distribution under the force of gravity, without leaving pockets for stray material to collect. Again, as shown in this example, the lower segment 108 can be formed of welded sheet steel (e.g., 4 plates), but other materials may also be used.

To function, the hopper 102 can be supported by a base 114 and frame 104. The base 114 can be generally dimensioned to match the cross-section of the upper segment 106 such that the outer walls or supports 110-1 and 110-2 can extend from the periphery of the base 114 to the periphery of the upper segment 106. In this example, the base 114 is generally rectangular in shape with the outer walls 110-1 and 110-2 being generally parallel to one another and extending to the transition between upper segment 106 and lower segment 108. Other shapes (such as generally oval, generally circular, or other rounded shapes) for the base 114 are also possible. In addition to having supporting cross-members (not labeled for the sake of simplicity), the base 114 also includes carriers 116-1 and 116-2, which are typically hollow tubes. As shown in the example of FIGS. 1-5, the carriers 116-1 and 116-2 have a generally rectangular cross-section. These carriers 116-1 and 116-2 are typically dimensioned and spaced apart from one another to receive tines of a fork. In the example shown, tines of the fork of loader 50 engage the carriers 116-1 and 116-2, so that the distribution box may be carried by loader 50. Secured (e.g., welded, brazed, or glued) to these carriers 116-1 and 116-2, for example, is an inner frame or support 112, which can also be secured (e.g., welded, brazed, or glued) to the lower segment 108. The inner support or inner frame 112 can then provide additional mechanical stability to the distribution box 100.

The material or dry, powdery mix that is contained with hopper 102 can then be distributed through a distribution assembly. The distribution assembly can be generally comprised of a pneumatic assembly 126, an ingress pipe 120, valve assembly 118, egress pipe 122, and spreader bar 124. The pneumatic assembly 126 can be generally comprised of a pneumatic pump that is driven by a hydraulic motor on the loader 50. Once the pneumatic assembly 126 is operating, high pressure air can be driven through the ingress pipe 120 to the valve assembly 118. The valve assembly 118 can be comprised of an ingress port that is coupled to the ingress pipe 120, an egress port that is coupled to the egress pipe 122, and a drop assembly that is coupled to the lower end of the lower segment 108. Typically, within the drop assembly, there is a valve (e.g., ball or butterfly valve) that is remotely actuatable (e.g., by electric motor, hydraulics, or pneumatics) by the driver within the cab of the loader 50. When the valve within the valve assembly 118 is actuated, the dry, powdery mixture can be moved under the force of gravity or "dropped" through an opening or exit port in the lower segment 108 and the open valve. Because high pressure air can be introduced to the valve assembly by the ingress pipe 120, the "dropped" mixture can be moved into egress pipe 122 using the moving air (similar to the way an atomizer may move perfume with air). The mixture can then move from the egress pipe 122 to the spreader bar 124 to be distributed onto the unfinished road surface. Additionally, at the bottom of the hopper 102, an extruder screw assembly or other means ease the mixture toward the valve assembly 118—like pneumatic aerators—may be used.

As a result of the configuration of the loader 50 and distribution box 100, the mixture can be precisely distributed. In operation, a driver would engage carriers 116-1 and 116-2 with tines of a fork of a loader 50 and lift the distribution box 100. The driver can then activate pneumatic pump with a hydraulic motor of the loader to generate pneumatic pressure in the ingress pipe 120 so as to provide moving air to the ingress port of the valve housing of the valve assembly 118. The narrowing of lower segment 108 can then creates a pressure gradient on the mixture (e.g., a binder like cement) at an exit port of a hopper 102. As the driver activates the valve secured to the valve housing at the exit port of the hopper 102, the powdery mixture (e.g., binder like cement) is mixed with the air and carried through the egress pipe 122 to the spreader bar 124. The driver can be begin moving the loader 120 along the unfinished surface and distributing the mixture through the spreader bar 124 onto an unfinished surface while moving. Ideally, the distribution box 100 should distribute about 60 or 80 pounds of the mixture per square yard. To accomplish this, the driver can use the onboard instrumentation of the loader 50 to measure the weight of the distribution box 100. By making this measurement, the driver is able to estimate whether too much or too little of the mixture (e.g., binder) is being distributed. If so, the driver can adjust to speed of the loader to accommodate.

Having thus described the present disclosure by reference to certain of its embodiments, it is noted that the embodiments disclosed are illustrative rather than limiting in nature and that a wide range of variations, modifications, changes, and substitutions are contemplated in the foregoing disclosure and, in some instances, some features of the present disclosure may be employed without a corresponding use of the other features. Accordingly, it is appropriate that the appended claims be construed broadly and in a manner consistent with the scope of the disclosure.

The invention claimed is:

1. An apparatus comprising:
- a hopper having:
  - a substantially closed interior space that is configured to receive a binder;
  - a fill assembly that is configured to be in fluid communication with the interior space of the hopper; and
  - an exit port;
- a base that is secured to the hopper, wherein the base includes at least one carrier;
- a pneumatic pump that is secured to the hopper;
- an ingress pipe that is secured so as to be in fluid communication with the pneumatic pump and that is secured to the base;
- a valve housing that is secured to the ingress pipe and the exit port of the hopper, wherein the valve assembly is configured to be in fluid communication with the pneumatic pump;
- a valve that is secured within the valve housing, wherein the valve is configured to be pneumatically controlled;
- an egress pipe that is secured to the valve housing and that is secured to the base; and
- a spreader bar that is secured to the egress pipe.

2. The apparatus of claim 1, wherein the hopper further comprises:
- an upper segment that is secured to the fill assembly; and
- a lower segment having the exit port, wherein the lower segment narrows between upper segment and the exit port.

3. The apparatus of claim 2, wherein the upper segment is substantially circular and wherein the lower assembly is substantially frustoconical in shape.

4. The apparatus of claim 2, wherein the apparatus further comprises a frame secured between the hopper and the base.

5. The apparatus of claim 4, wherein the carrier of the base further comprises first and second carriers, wherein each of the first and second carriers is substantially rectangular in shape and is dimensioned to receive a fork tine, and wherein the first and second carriers are substantially parallel to and separated from one another.

6. The apparatus of claim 5, wherein the base is substantially rectangular, and wherein the upper assembly is substantially rectangular with substantially the same area as that of the base.

7. The apparatus of claim 6, wherein the frame further comprises:
- a first outer wall that is secured along a first edge of the base and a first edge of the upper segment;
- a second outer wall that is secured along a second edge of the base and a second edge of the upper segment, wherein the first and second outer walls are substantially parallel to one another; and
- an inner support that is secured to the first and second carriers and the lower segment.

8. An apparatus comprising:

a base having a first area, wherein the base includes first and second carriers that each have a substantially rectangular cross-section and a length such that the first and second carriers are dimensioned to receive a tine of a fork, and wherein the first and second carriers are spaced apart from one another and are generally parallel to one another;

a first outer wall that is secured along at least a first portion of the periphery of base;

a second wall that is secured along at least a second portion of the periphery of the base;

an inner support that is secured to the first and second carriers;

a hopper having:

an upper segment having a second area; and a lower segment having an upper end and a lower end, wherein the upper end of the lower segment is secured to the upper segment at a transition, and wherein the first outer wall is secured along a first portion of the transition, and wherein the second outer wall is secured along a second portion of the transition, and wherein the lower segment includes an exit port with a third area at the lower end of the lower segment, and wherein the third area is less than the second area, and wherein the inner support is secured to the lower segment;

a valve housing that is secured to the exit port;

a pneumatic pump;

an ingress pipe that is secured between the pneumatic pump and the valve housing, wherein the ingress pipe is secured to the base;

an egress pipe that is secured to the valve housing and the base;

a valve that is secured with the valve housing, wherein the valve is configured to be pneumatically actuated; and a spreader bar that is secured to the egress pipe.

9. The apparatus of claim 8, wherein the hopper has an interior space, and wherein the apparatus further comprises a fill assembly that is secured to the hopper and is in fluid communication with the interior space of the hopper.

10. The apparatus of claim 9, wherein the first and second areas are substantially circular.

11. The apparatus of claim 10, wherein the lower segment has a substantially frustoconical shape.

12. The apparatus of claim 9, wherein the first and second areas are substantially rectangular.

13. The apparatus of claim 12, wherein the first and second areas substantially the same.

14. The apparatus of claim 13, wherein the first and second outer walls are substantially parallel to one another.

* * * * *